US006243968B1

(12) United States Patent
Conrad et al.

(10) Patent No.: US 6,243,968 B1
(45) Date of Patent: Jun. 12, 2001

(54) TURNING DEVICE FOR SLUDGE AND DEPOSITS AND SOLAR DRIER HAVING A TURNING DEVICE

(76) Inventors: Tilo Conrad, Landhausstrasse 101, Stuggart D-70190; Markus Bux, Filderhauptstrasse 37, Stuttgart D 70599, both of (DE)

( * ) Notice: Subject to any disclaimer, the term of this patent is extended or adjusted under 35 U.S.C. 154(b) by 0 days.

(21) Appl. No.: 09/441,364

(22) Filed: Nov. 17, 1999

(51) Int. Cl.[7] ..... F26B 3/34

(52) U.S. Cl. ..... 34/255; 34/266; 34/275; 34/62; 34/93; 34/201

(58) Field of Search ..... 34/255, 266, 275, 34/62, 93, 201, 209, 235

(56) References Cited

U.S. PATENT DOCUMENTS

| | | | | |
|---|---|---|---|---|
| 4,481,114 | * | 11/1984 | Riise | 210/702 |
| 5,389,249 | * | 2/1995 | Richards | 210/188 |
| 5,428,904 | * | 7/1995 | Rutz | 34/219 |

FOREIGN PATENT DOCUMENTS

| | | |
|---|---|---|
| 39 26 269 | 2/1991 | (DE) . |
| 42 15 530 | 9/1993 | (DE) . |
| 43 15 321 | 11/1994 | (DE) . |
| 43 31 820 | 3/1995 | (DE) . |
| 195 08 400 | 9/1996 | (DE) . |

* cited by examiner

*Primary Examiner*—Pamela Wilson
(74) *Attorney, Agent, or Firm*—Paul Vincent

(57) ABSTRACT

A turning device (8) for sludge and deposits (3) is proposed which moves along differing paths spread out on a floor (6), through the sludge or deposit (3). The turning device (8) can be used in a solar drier for sewage sludge or other deposits.

25 Claims, 5 Drawing Sheets

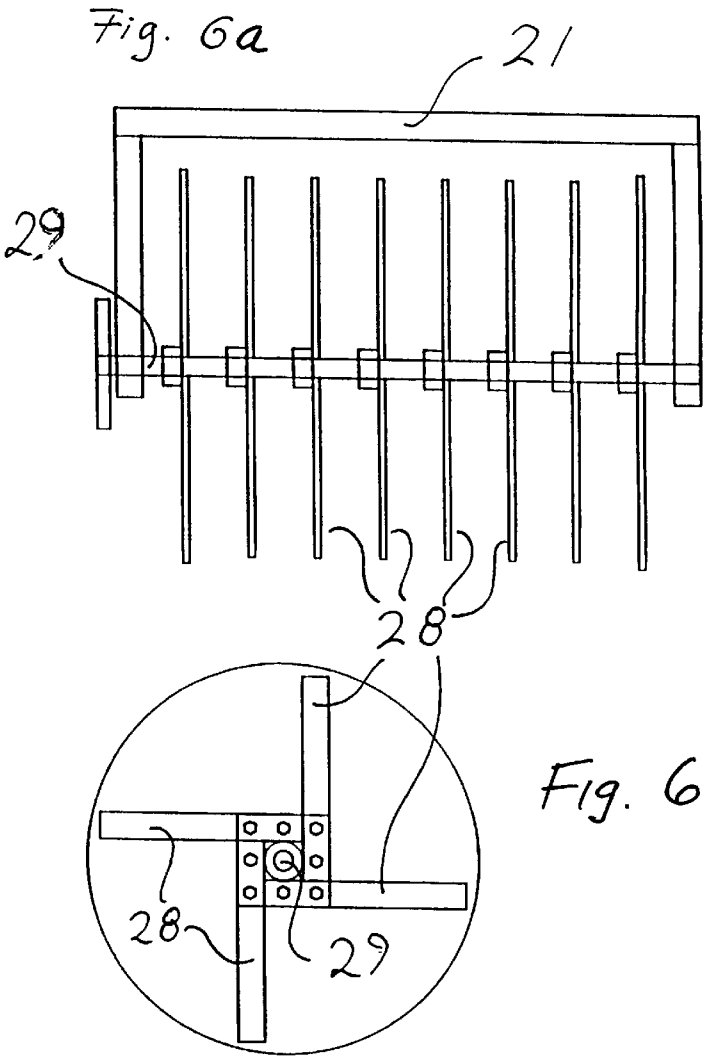
Fig. 6a
Fig. 6b
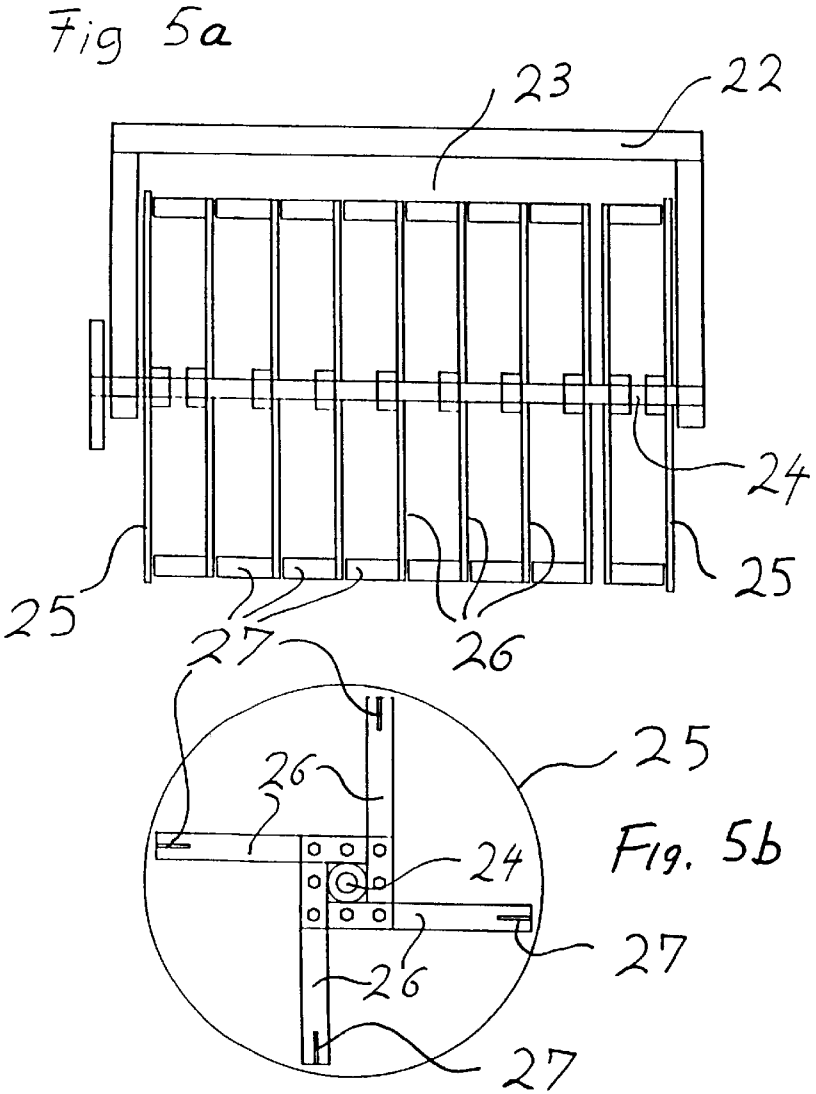
Fig 5a
Fig. 5b

TURNING DEVICE FOR SLUDGE AND DEPOSITS AND SOLAR DRIER HAVING A TURNING DEVICE

BACKGROUND OF THE INVENTION

The invention concerns a turning device for sludge and/or deposits and a solar drier having a turning device. Sludge or deposits are often dried on a stable floor or in flat pools. In order to increase the drying efficiency, the product to be dried is turned over when the uppermost layer is dry and moisture transport from the lower sludge layers into the air is impaired.

In a conventional turning device categorizing the invention (DE OS 4315321 A1), the device extends across the entire width of the drying surface and is guided and driven at the sides thereof. This turning device has the disadvantages of having substantial structural difficulty and expense, of being limited by the width of the drying surface, of requiring guiding means on both sides of the drying surface as well as of requiring a drive device on at least one side thereof. In addition, this complicated and expensive device is not efficiently utilized. The entire product to be dried is turned during one single passage of the turning device over the drying surface. Since the drying proceeds slowly, the inactive time of the turning device is long in comparison to the active time.

The invention also concerns a solar drier having a turning device. In view of the limited amount of natural resources, increased efforts have been made in recent times to utilize solar energy for drying processes of various kinds. This is attractive from an economical point of view when no particular requirements are made for the drying speed and for high temperatures. In this manner, deposits or other sludge can often be dried using solar means, resulting in low operational costs for the drying procedure and conservation of natural resources in an environmentally sound fashion.

A device and a method for solar drying of sludge and soiled liquids is described in a solar drier of conventional construction categorizing the invention (DE OS 4315321 A1) with which the sludge is transported into a precipitation pool, wherein a portion of the water is removed using a drainage pipe. A turning and transport device, extending across the entire width of the pool and of the adjacent drying surface, is then used to transport the somewhat thickened sludge from the precipitation pool onto the drying surface. The sludge is disposed at this location in the form of a relatively thin layer and is dried by an opposing stream of air. The drying speed is increased using a greenhouse structure erected over the drying surface and the precipitation pool. The incident solar radiation heats the sludge and the air located within the greenhouse leading to the above mentioned increase in drying speed. The required convection within the greenhouse is produced by a chimney installed, as seen in the flow direction of the air, on the rear end of the greenhouse. In the event that natural convection is insufficient, an electrically driven fan can increase the draft in the chimney. This conventional solar dryer for solar drying of sewage sludge has the disadvantage of being associated with a relatively high degree of structural difficulty and expense related to the chimney, the complicated and expensive turning and transport device, the precipitation pool, a pressurized installation, an external solar collector as well as dehumidifying devices.

SUMMARY OF THE INVENTION

In contrast thereto, the turning device in accordance with the invention has the advantage that the degree of structural difficulty and expense is substantially reduced, wherein use of a smaller and flexibly controllable turning device not only saves substantial investment and operation costs but allows the turning device to be operated in a manner which is adapted to the product being dried. In addition, the efficiency of use of the turning device is increased by a plurality of passages through the product to be dried and the drying device can be loaded to an increased extent and thereby utilized in a more efficient manner due to the intense mixing of the product to be dried.

In accordance with an additional advantageous configuration of the invention, the distribution tool is fixed to a frame so that the penetration depth of the distribution tool into the sewage sludge can be easily adjusted.

In accordance with an additional advantageous configuration of the invention, the distribution tool is motor-driven so that mixing of dried and moist sludge layers is intensified.

According to an additional advantageous embodiment of the invention associated therewith, the processing speed and the processing direction of the distribution tool can be regulated and controlled in dependence on the consistency of the sludge and the driving mechanism.

In accordance with an additional advantageous embodiment of the invention, the drive device and, optionally, the distribution tool are electrically powered so that the drive mechanism requires little maintenance, is economical and is robust.

In accordance with an additional advantageous embodiment of the invention associated therewith, the turning device is provided with electrical energy via a tracking device disposed on the building and a power cable so that the motors can be operated with power from the mains, leading to low power loss. In addition, electrical energy coming from the mains is regularly available end-user energy, which is relatively inexpensive.

In accordance with an additional advantageous embodiment of the invention, the turning device is supplied with electrical energy via storage batteries so that the turning device can be operated in an isolated fashion.

In accordance with an additional advantageous configuration of the invention, the drive device and, optionally, the distribution tool are at least indirectly driven by a combustion engine so that high drive power is possible with low weight.

In accordance with an additional advantageous configuration of the invention, the direction of motion and the speed of the turning device are controlled by a shifting system disposed on the turning device which is actuated by at least one delimiting device disposed on the edge of the floor.

In accordance with an additional advantageous configuration of the invention, the path of the turning device is determined in a stochastic fashion via the collision between the turning device and the delimiting device so that an even mixing is also guaranteed in the edge regions of the floor.

In accordance with an additional advantageous configuration of the invention, the path of the turning device is adjusted by an actuator disposed between portions of the frame to move the turning device along predetermined paths.

In accordance with an additional advantageous configuration of the invention, the turning device moves along fixed paths so that the path length or the efficiency of the turning device can be optimized.

In accordance with an additional advantageous embodiment of the invention associated therewith, the path is determined by a stationary ultrasonic or infrared transmitter in conjunction with a receiver disposed on the turning device, the receiver controlling the direction of motion of the turning device via appropriate actuators to easily adapt control to differing external boundary conditions.

In accordance with an additional advantageous configuration of the invention, the paths are defined by induction loops disposed in the floor so that the control of the turning device on predetermined paths is robust and insensitive to soiling.

In accordance with an additional advantageous configuration of the invention, the path control of the turning device is effected with the assistance of a satellite navigation apparatus so that no devices are required in addition to the turning device.

In accordance with an additional advantageous configuration of the invention, the active width of the distribution tool is substantially smaller than the length or the width of the floor, to thereby improve efficiency of use of the distribution tool and to reduce investment costs.

In addition, the solar drier in accordance with the invention has the advantage that its drying efficiency is high despite the simple and economical structure.

In accordance with an additional advantageous embodiment of the invention related thereto, the floor has precipitation sections and drying sections so that a portion of the moisture can flow-off through the precipitation sections.

In accordance with an additional advantageous configuration of the invention related thereto, the precipitation section consists essentially of single grain concrete and the liquid draining through the precipitation section is collected in a container so that a portion of the liquid contained in the sludge or deposit is drained-off to thereby increase the drying efficiency of the solar drier.

In accordance with an additional advantageous configuration of the invention, the delimiting sides of the precipitation sections extend substantially parallel to the outer edges of the floor so that moisture pockets do not form in the edge regions of the floor.

In accordance with an additional advantageous configuration of the invention, the floor can support farming machines so that turning and removal of the dried substrate can be effected in a rapid fashion using available machines and apparatus.

In accordance with an additional advantageous configuration, the solar drier comprises a turning device in accordance with the invention.

In accordance with an additional advantageous embodiment of the invention, the delimiting device is up to 3 meters in height so that the solar drier can also be used as a temporary storage unit.

In accordance with an additional advantageous embodiment of the invention, the building enclosure has an air inlet and an air outlet to increase drying efficiency.

In accordance with an additional advantageous embodiment of the invention associated therewith, the air inlet and air outlet are regulated in order to further increase the drying power.

In accordance with an additional advantageous embodiment of the invention associated therewith, the exhaust is suctioned off and an exhaust filter is disposed on the air outlet so that the entire exhaust is guided through the exhaust filter to effect a slight partial pressure within the building.

In accordance with an additional advantageous embodiment of the invention, a dehumidifier is disposed within the building enclosure so that there is no exchange of air between the inside of the building and the surrounding environment to prevent unpleasant odors from escaping out of the drier.

In accordance with an additional advantageous embodiment of the invention, plants grow on the sludge or deposit (reeds or the like) so that the drying efficiency is increased by the increased drying surface. In addition, this measure leads to an increase in the caloric content of the dried sewage sludge or deposits, including the plants, compared to the caloric content of the dried sewage sludge or deposit only.

Further advantages and advantageous configurations of the invention can be extracted from the subsequent description, the drawings and the claims.

An embodiment in accordance with the invention is shown in the drawings and more closely described below.

BRIEF DESCRIPTION OF THE DRAWING

FIG. 5*a* shows a first view of the drive roller,

FIG. 5*b* shows a second view of the drive roller,

FIG. 6*a* shows a first view of the hacking roller,

FIG. 6*b* shows a second view of the hacking roller.

DESCRIPTION OF THE PREFERRED EMBODIMENT

Figure 1:
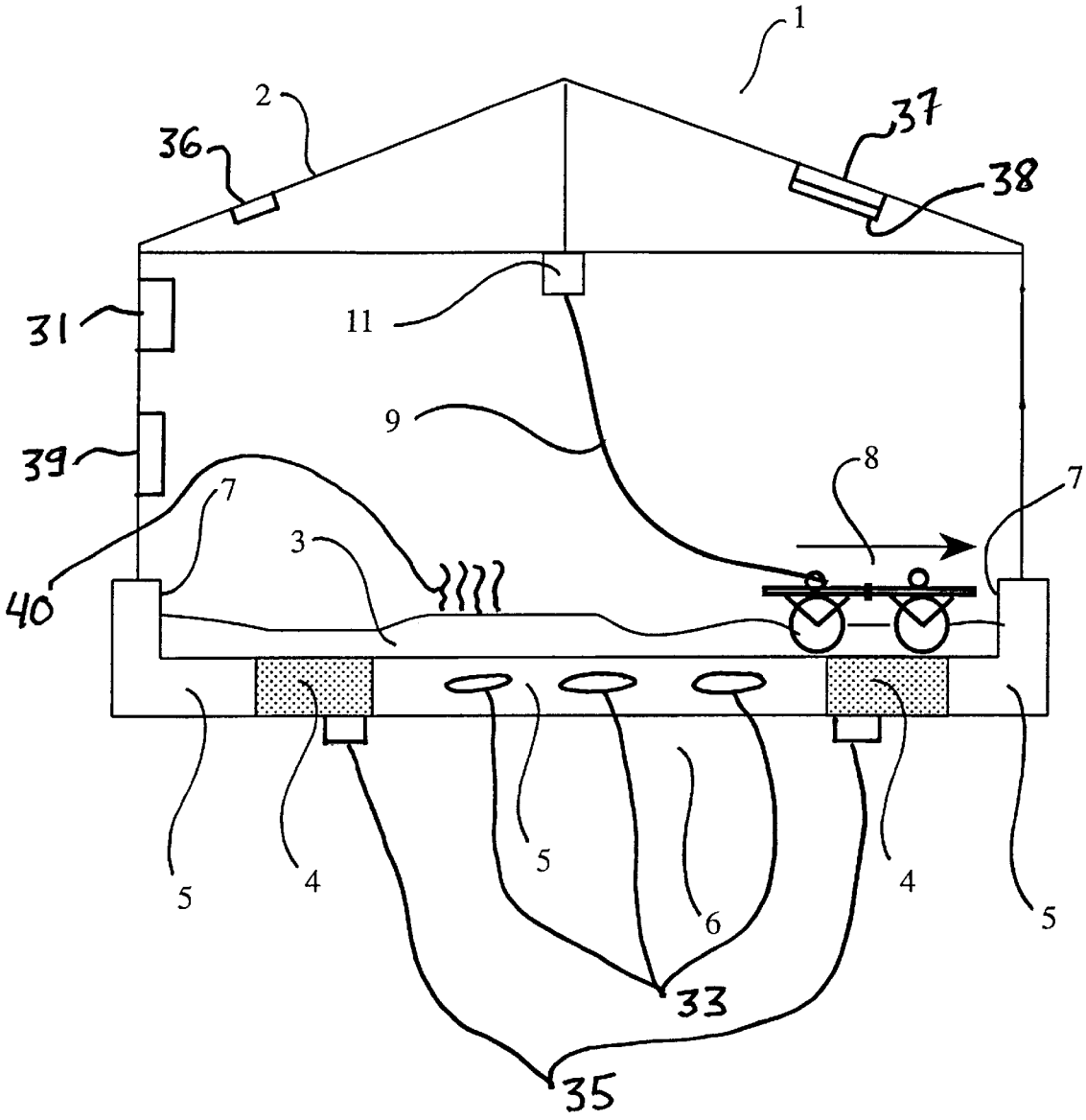
FIG. 1 shows a cross section through a solar drier having a turning device.

FIG. 1 shows a building 1 having the conventional construction of a greenhouse. The building enclosure 2 consists essentially of a transparent heat insulating plastic, such as e.g. a PE insulating air cushion sheet, which is permeable to solar radiation. Sewage sludge 3 is located on the floor 6 of the building 1. Solar radiation incident on this sewage sludge 3 leads to warming thereof. Since the warmed sewage sludge 3 radiates heat having longer wavelength than that of sunlight and since the building enclosure 2 absorbs light of these longer wavelengths, only a small fraction of this radiation can escape from the building enclosure 2. The floor 6 of the building, consisting essentially of the precipitation sections 4 and drying sections 5, can be seen within the building enclosure 2. Delimiting devices, in the form of side walls 7 can also be seen. The delimiting deices can contain the sludge and prevent it from sinking into the surrounding earth and can also steer the turning device 8. The precipitation sections 4 consist essentially of single grain concrete and allow a portion of the liquid contained in the sludge 3 to pass through, whereas the solid components of the sludge are blocked. The collecting device for the drained liquid is not shown. Since the precipitation sections 4 are large compared to the overall floor 6, the single grain concrete absorbs solids at a slow rate. Should the concrete become clogged with solids, it can be cleaned using water. The turning device 8 travels back and forth in or on the sewage sludge 3 and effects a mixing of dry and moist sewage sludge layers using a distribution tool 17 (schematically shown). In order to illustrate the manner of operation of the turning device 8, we assume that it is travelling towards a side wall 7 in FIG. 1. As soon as the turning device 8 touches the wall 7, a turning device 8 shifting system is triggered, as a result of which it changes its direction and curvature of motion to move away from the edge of the base surface 6. Approach and retraction of the turning device 8 from the side walls 7 is effected along differing paths. The turning device 8 is supplied with energy by means of a power cable 9 attached to a tracking device 11 extending in the longitudinal direction of the hall. This tracking device 11 allows the turning device 8 to travel across the entire base surface 6 without damaging the power cable 9.

Figure 2:
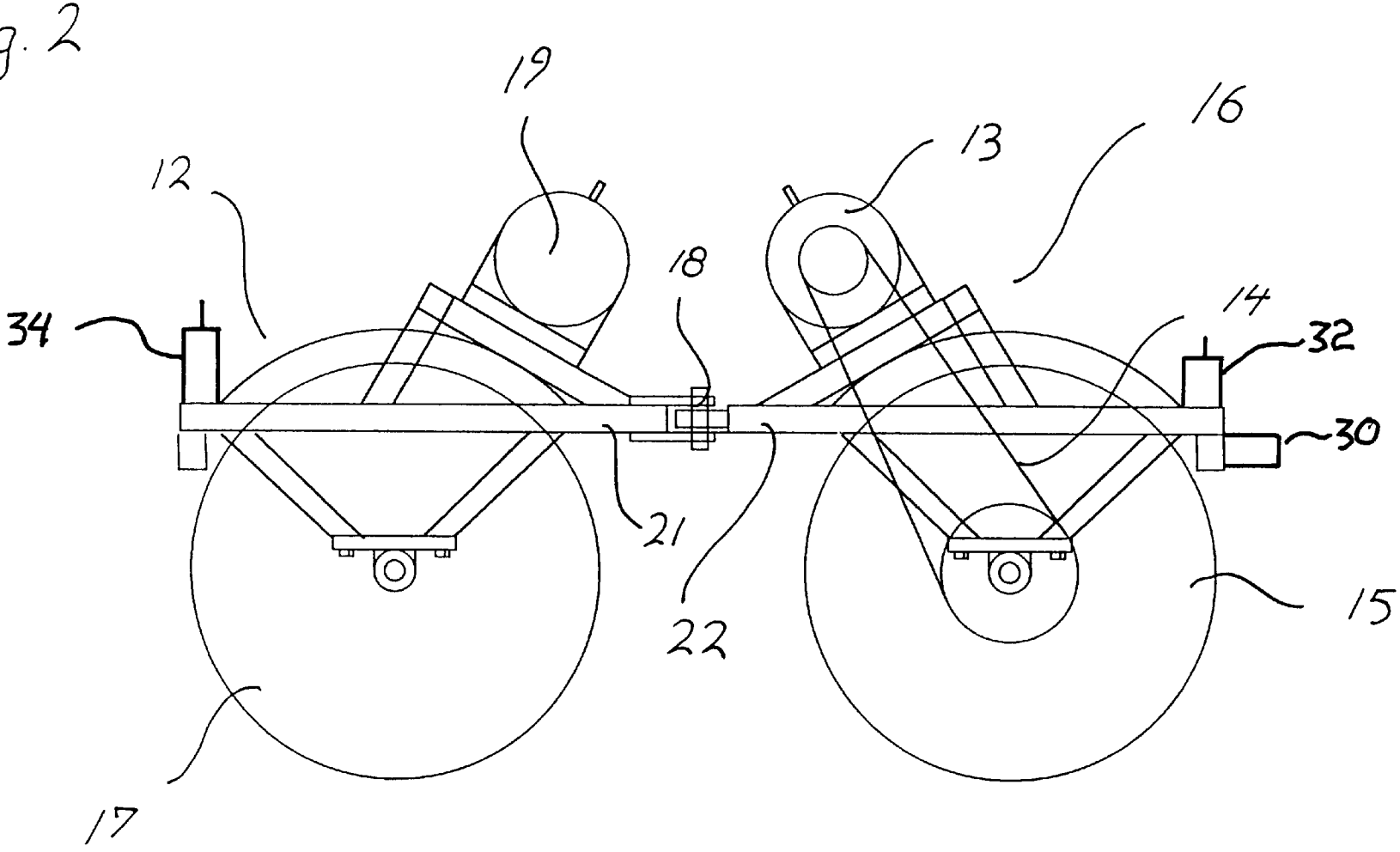
FIG. 2 shows a side view of the turning device.

FIG. 2 shows a side view of the turning device 8. A frame 12 connects the drive device 16, consisting essentially of a motor 13, a transmission element 14 and a drive roller 15 to the distribution tool 17 in a hinged fashion. The ability of the drive device 16 and the distribution tool 17 to change their position relative to each other via the hinge 18 in the frame 12, permits the turning device 8 to travel through curves having differing radii. In the embodiment shown, the distribution tool 17 is driven by a motor 19.

Figure 3:
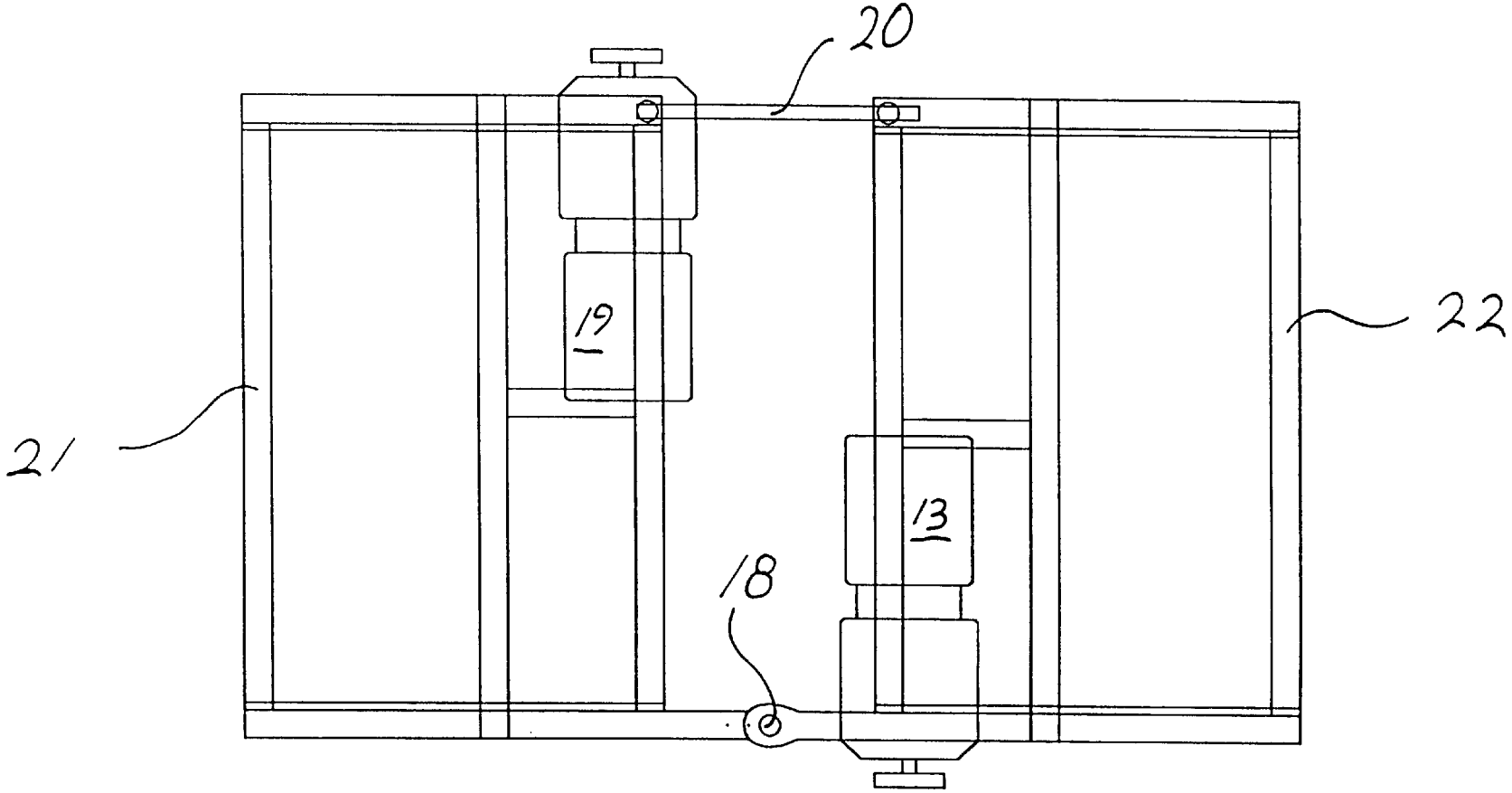
FIG. 3 shows a plan view of the turning device in straight travel.

FIG. 3 shows a plan view of the turning device 8. One clearly sees that the hinge 18 is not centered in the drive direction. A connecting element 21 is located on the side of the frame 12 opposite to the hinge 18, to increase the stiffness of the frame 12 and reduce the relative motion between the two frame portions 21, 22. Should the turning device 8 travel along predetermined paths, the connecting element 20 can be configured as a control cylinder. When the turning device 8 is incident on a side wall 7 or another encumbrance, the drive direction of the drive device 16 and of the distribution tool 17 change. The angle between the frame portions 21, 22 changes simultaneously. This change in angle is effected by a reversal in drive direction, a collision between the turning device 8 and an obstacle, or by means of an actuator (electrical or pneumatic cylinder) 20. The turning device 8 thereby travels away from the side wall 7 or the obstacle along a path which differs from that along which it was incident thereon. Practical experiments have shown that a stochastic path control can be achieved in this fashion to cover the entire base surface, wherein the required path length for the turning device 8 is approximately 3 times the quotient between the base area and the active width of the turning device 8. Longer turning device 8 paths intensify mixing of the sewage sludge 3.

Figure 4A:
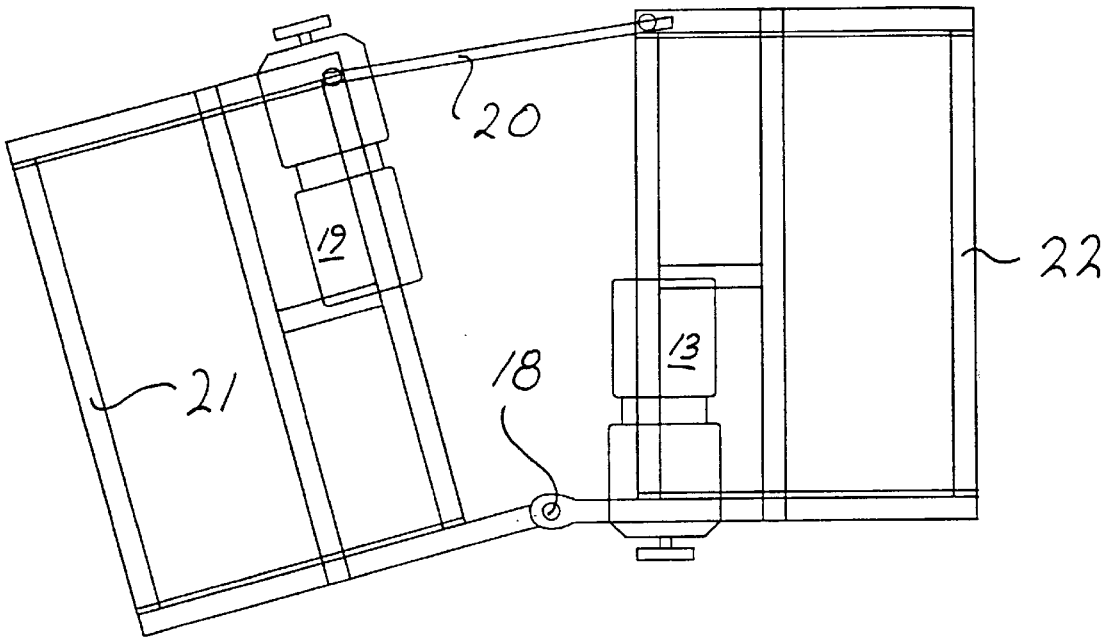
FIG. 4*a* shows a first plan view of the turning device in curved travel.
Figure 4B:
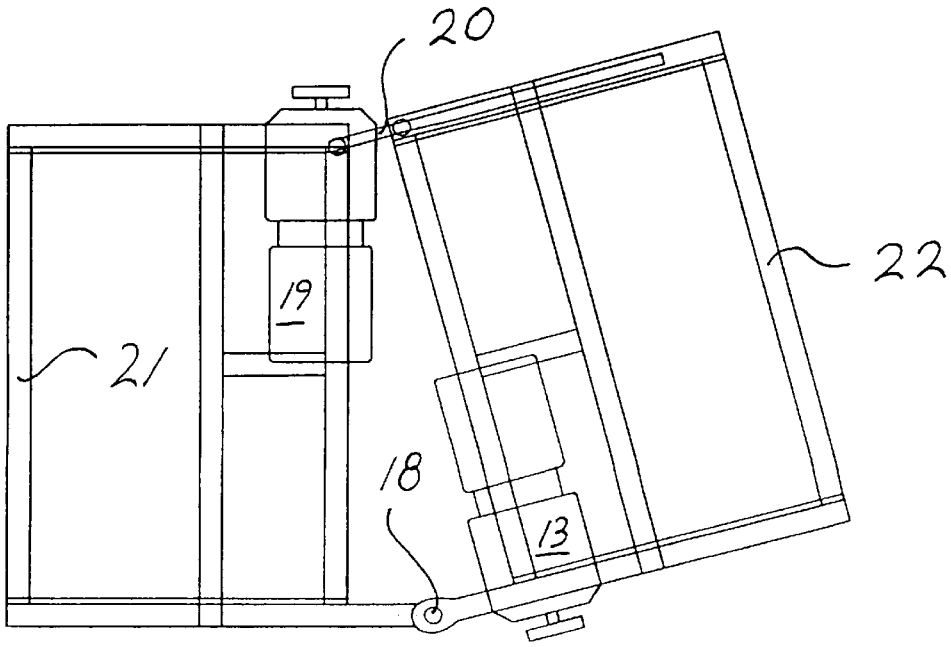
FIG. 4*b* shows a second plan view of the turning device in curved travel.

FIGS. 4*a* and 4*b* show plan views of the turning device 8 in curved travel.

FIGS. 5*a* and 5*b* show a drive roller 15 from the front, in section. The drive roller 15 consists essentially of two disc wheels 25 disposed on a shaft 24 between which a plurality of spokes 26, which do not project beyond the disc wheels 25, are disposed in a plurality of planes. The spokes 26 have drive means 27 extending parallel to the longitudinal axis of the drive roller 15 to improve the positive and frictional engagement between the drive roller 15 and the sewage sludge 3.

FIGS. 6*a* and 6*b* show a distribution tool configured as a hacking roller 17. Disc wheels are provided on the hacking roller 17 having a somewhat larger radius than the hacking tools 28 to ensure that the turning device 8 operates reliably for a long period of time and for protecting the hacking tool 28 from being damaged. In the embodiment shown, a plurality of hacking tools 28 are aligned on the hacking roller 29 in a plurality of planes. They are made e.g. from flat steel which could have a profiled cross section. The velocity of the drive device 16 influences the operating power of the hacking roller 17. The speeds of the drive device 16 and the distribution tool 17 must be adapted to each other to guarantee a proper mixing of the sewage sludge 3 without overloading the drive motors 13 and 19.

The sludge or deposit (drying product) which is to be dried can be mixed with additives such as wood chips, paper or plant materials (reeds or the like). This increases the caloric content of the mixture comprising the product to be dried and the additives to values in excess of 11 MJ per kg. The dried mixture can then be used as a fuel and is no longer refuse. In addition, the additives can extend the carbon to oxygen ratio of the mixture compared to that of the pure drying product for reducing emissions. Mixture of the drying product with the additives can be effected before or after drying. The mixture process can make transportation of the mixture worthwhile, increase its potential for storage, and increase its caloric content.

The precipitation sections of the solar drier can consist essentially of single grain concrete plates inserted into corresponding depressions in the floor. They can be removed for cleaning purposes. Perforated sheets or grids (e.g. so-called Birko channels) can also be used instead of single grain concrete plates. In this case, the precipitation sections consist essentially of troughs introduced into the floor which are not permeable to water and which can be emptied using drainage pipes. The troughs are filled with coarse grained gravel, fine grained gravel and sand and optionally with fiber material. The covering grid or the perforated sheet are dimensioned in such a fashion that vehicles can travel thereon.

The solar drier is also suitable for the drying and sterilization of animal excrement, wherein other materials can also be added in order to reduce odors. In addition, the drier can be used for the drying of biological refuse, grass or clippings, either alone or together with sewage sludge, and other depositions. In the event that the drier is used to dry biological refuse, thermal applications can be envisioned in addition to the generation of compost therefrom. In addition, the device can be used for drying bulk products such as e.g. coffee, cocoa or rice.

As shown in FIGS. 1 and 2, the turning device 8 can be controlled by a switching or transmission device 30 interacting with the delimiting wall 7. Alternatively or in addition thereto, an ultrasonic or infrared transmitter 31 can communicate control messages to a receiver 32 disposed on the turning device 8. Induction loops 33 can also be provided in the floor 5 for controlling the path of the turning device 8. Means 34 can be provided for tracking and controlling the turning device using satellite navigation. Liquid passing through porous sections 4 can be captured in conduit receptacles 35. The building 1 can comprise regulated air inlet 36 and air outlet 37 passages, wherein the air outlet passage 37 has a filter 38. In addition or alternative thereto, a dehumidifier 39 can be used within the building 1. The caloric content and drying speed can also be increased by plants 40 growing on the sludge.

The features shown in the description, the subsequent claims and the drawing can be important to the invention either individually or in arbitrary combination.

LIST OF REFERENCE SYMBOLS

1 building
2 building enclosure
3 sewage sludge
4 precipitation section
5 drying section

6 floor
7 delimiting wall
8 turning device
9 power cable
11 tracking device
12 frames
13 drive device motor
14 transmission element
15 drive roller
16 drive device
17 distribution tool
18 hinge
19 distribution tool motor
20 connection element
21 frame member
22 frame member
24 drive shaft
25 disc wheels
26 spokes
27 drive means
28 hacker tool
29 hacker shaft
30 Switching or transmission device
31 transmitter
32 receiver
33 induction loops
34 satellite navigation means
35 conduits
36 air inlet
37 air outlet
38 filter
39 dehumidifier
40 plants

We claim:

1. A turning device for sludge or deposits disposed on a floor of a building, the floor having a length and a width, the building having a tracking device and a power cable connected to the tracking device, the building also having a delimiting means disposed on an edge of the floor and with at least one of an ultrasonic and infrared transmitter for controlling the turning device, and the floor also having induction loops for controlling the turning device, the turning device comprising:

a frame having a first portion and a second portion;

hinging means connecting said first and said second portions for pivoting;

a drive device disposed on said first frame portion to move the turning device, said drive device in constant contact with the sludge;

a distribution tool disposed on said second frame portion for mixing the sludge; and means for controlling a speed and a direction of the turning device along at least one of a stochastic path and a predetermined path.

2. The turning device of claim 1, wherein said distribution tool is mounted to said second frame portion for rotation relative thereto.

3. The turning of claim 1, wherein said controlling means comprise motor means for driving said distribution tool.

4. The turning device of claim 1, wherein said distribution tool comprises one of a hacker and a conveyor screw.

5. The turning device of claim 1, wherein said controlling means comprise means for regulating a processing speed and a processing direction of said distribution tool.

6. The turning device of claim 1, wherein said controlling means comprise means for electrically driving at least one of said drive device and said distribution tool.

7. The turning device of claim 6, wherein said electrical drive means comprise connection means to the tracking device via the power cable.

8. The turning device of claim 6, wherein said electrical drive means comprise a storage battery.

9. The turning device of claim 1, wherein said controlling means comprise an internal combustion engine.

10. The turning device of claim 1, wherein said controlling means comprise a switching and transmission device disposed on the turning device for interaction with the delimiting means.

11. The turning device of claim 10, wherein said switching and transmission device cooperates with the delimiting device through collision therewith to steer the turning device along said stochastic path.

12. The turning device of claim 1, wherein said controlling means comprise an actuator disposed between said first and said second portions to adjust at least one of said stochastic path and said predetermined path.

13. The turning device of claim 12, wherein said controlling means comprise a receiver communicating with the ultrasonic or infrared transmitter to regulate said direction of the turning device using said actuator.

14. The turning device of claim 13, wherein at least one of said ultrasonic and infrared transmitter communicates with the induction loops in the floor.

15. The turning device of claim 1, wherein said controlling means comprises satellite navigation means.

16. The turning device of claim 1, wherein the turning device has an active width substantially smaller than the length and the width of the floor.

17. A solar drier for sludge or deposits, the drier comprising:

a floor for accepting the sludge or deposits in a distributed manner;

a building enclosure extending upwardly from and covering said floor, said building enclosure comprising sections partially permeable to light;

a turning device for moving over said floor along paths to mix the sludge or deposits; and delimiting means disposed at a peripheral portion of said floor to contain said turning device and to contain the sludge or deposits, wherein said floor comprises a precipitation section and a drying section, wherein said precipitation section consists essentially of single grain concrete and further comprising means for capturing liquid passing through said precipitation section.

18. The solar drier of claim 17, wherein said precipitation section has edges extending substantially parallel to outer edges of said floor.

19. The solar drier of claim 17, wherein said floor has a strength sufficient for supporting farming machines.

20. A solar drier for sludge or deposits, the drier comprising:

a floor for accepting the sludge or deposits in a distributed manner;

a building enclosure extending upwardly from and covering said floor, said building enclosure comprising sections partially permeable to light;

a turning device for moving over said floor along paths to mix the sludge or deposits; and delimiting means disposed at a peripheral portion of said floor to contain said turning device and to contain the sludge or deposits, wherein said turning device comprises a frame having a first portion and a second portion; hinging means connecting said first and said second portions for pivoting; a drive device disposed on said first frame portion to move the turning device, said drive device in constant contact with the sludge; a distribution tool disposed on said second frame portion for mixing the sludge; and means for controlling a speed and a direction of the turning device along at least one of a stochastic path and a predetermined path.

21. The solar drier of claim 20, wherein said delimiting means comprise wall means having a height above said floor which is less than or equal to about three meters.

22. The solar drier of claim 20, wherein said building enclosure has an air inlet and an air outlet.

23. The solar drier of claim 22, wherein said air outlet comprises an exhaust filter.

24. The solar of claim 20, further comprising an air dehumidifier disposed within said building enclosure.

25. The solar drier of claim 20, further comprising plants growing on the sludge or deposit.

* * * * *